US005427146A

United States Patent [19]

Bakken et al.

[11] Patent Number: 5,427,146

[45] Date of Patent: Jun. 27, 1995

[54] LINEARLY ADJUSTABLE FLUID DAMPER

[76] Inventors: Gary M. Bakken, 340 E. Canyon View Dr., Tucson, Ariz. 85704; Robert L. Schaller, 8851 N. Oracle Rd., #215, Tucson, Ariz. 85737

[21] Appl. No.: 265,916

[22] Filed: Jun. 27, 1994

[51] Int. Cl.[6] ..... F16K 3/34

[52] U.S. Cl. ..... 137/625.3; 137/625.33; 251/205

[58] Field of Search ..... 137/625.28, 625.3, 625.33; 251/205

[56] References Cited

U.S. PATENT DOCUMENTS

| | | | |
|---|---|---|---|
| 2,470,488 | 5/1949 | Honerkamp . | |
| 2,939,377 | 6/1960 | Stach . | |
| 2,976,795 | 3/1961 | Brugler . | |
| 3,223,019 | 12/1965 | Schuh . | |
| 3,393,627 | 7/1968 | Eurich . | |
| 4,319,520 | 3/1982 | Lanting . | |
| 4,407,187 | 10/1983 | Horney . | |
| 4,473,210 | 9/1984 | Brighton | 137/625.3 X |
| 4,666,477 | 5/1987 | Lough . | |
| 4,681,613 | 7/1987 | Porter | 251/205 X |
| 5,014,608 | 5/1991 | Benson . | |
| 5,218,998 | 6/1993 | Bakken | 137/625.3 X |

FOREIGN PATENT DOCUMENTS

| | | | |
|---|---|---|---|
| 1023845 | 1/1953 | France | 137/625.3 |

*Primary Examiner*—Robert G. Nilson
*Attorney, Agent, or Firm*—J. Michael McClanahan

[57] ABSTRACT

A linearly adjustable fluid damper of the sliding plate adjustable orifice type damper system having a fixed plate with a plurality of specifically arranged hexagonal shaped apertures therethrough and a slidable adjustable plate also having a plurality of specifically arranged hexagonal shaped apertures therethrough. The sliding plate is juxtaposed the fixed plate such that the apertures of the sliding plate overlap apertures of the fixed plate with center lines bisecting the top and bottom sides of apertures in both plates coinciding. The area of the resultant hexagonal composite orifice through both plates varies non-linearly from full closed position to full open position throughout movement of the sliding plate, however, the result is that fluid flow from zero to maximum through the resultant orifice is a straight line relationship with linear displacement of the sliding plate. Dampers comprising this configuration may thus be pre-set to predetermined openings in fluid flow operations to achieve desired results. In addition, throttling of the fluid flow near zero fluid flow is enhanced.

16 Claims, 4 Drawing Sheets

LINEARLY ADJUSTABLE FLUID DAMPER

BACKGROUND OF THE INVENTION

1. Field of the Invention

The field of the invention is adjustable orifice fluid dampers utilized in air and liquid handling systems such as those found in manufacturing and assembly clean rooms, ducts, pipes air handling and fluid flow systems.

2. Description of the Related Art

Fluid flow systems rely on the accurate adjustment of the fluid medium in consideration of static and dynamic conditions. In many cases, dampers are utilized in fluid flow systems for accurate adjustment of the fluid medium.

The prior Patent of one of the co-inventors, namely U.S. Pat. No. 5,218,998, issued Jun. 15, 1993 to the subject co-inventor Gary M. Bakken as well as to inventors Phillip E. Branham and William R. Acorn, and incorporated herein by reference, details an invention of a sliding plate orifice damper system. In such damper systems, the fixed plate has a plurality of specifically arranged trapezoidal shaped apertures therethrough and the slideably adjustable plate overlying the fixed plate also has a plurality of specifically arranged trapezoidal shaped apertures therethrough. The sliding plate is juxtaposed the fixed plate such that the apertures of the sliding plate will overlap apertures of the fixed plate, however, the aperture orientation of the sliding plate is reversed relative the orientation of the apertures of the fixed plate. The result is that the area of the resultant composite hexagonal orifice through both plates varies non-linearly from full open position to full closed position throughout movement of the sliding plate. The functional result is, however, that fluid flow through the resultant orifice from zero to maximum fluid flow is a straight line relationship with linear displacement of the sliding plate (relative to the fixed plate). That being so, dampers comprising this configuration may be preset to pre-determined orifice openings to achieve desired fluid flow results.

While the invention of the above referenced patent achieves the results sought, yet by the construction of the trapezoidal apertures in each of the plates, the volume of fluid which could flow through the damper system is limited from what otherwise might be. After much study and reflection upon the prior invention, it was noticed by the co-inventors of the invention herein that a rather large portion of the area of the two plates did not actually contribute to the resultant hexagon shaped orifice through the overlapping plates. Accordingly, a study was set out to determine how the area devoted to the resultant hexagonal orifices formed of the two plates could be increased so that the ratio of the resultant orifices to the total area of the sliding plate fluid damper might be substantially increased to result in increased fluid flow. Increased fluid flow results in more efficient use of expensive treated fluid, reduced operating costs and equipment costs.

Due to the shape of the trapezoidal apertures it was determined that a substantial part of each aperture in each plate did not contribute to the forming of the resultant hexagonal shaped orifice from complete closure of the orifice to maximum opening. Thus, the task became one of preserving the hexagonal shaped resultant orifice while the plates are moved relative to each other and simultaneously situating more of these orifices on the sliding plate fluid damper system (assuming the size of each orifice does not change). To accomplish such a feat, the apertures on one or both of the plates, i.e., the fixed plate and/or the sliding plate, must be so situated as to be much closer to each other in order to increase the ratio of resultant hexagonal shaped orifice area to the total area of the fluid damper. Obviously this could not be accomplished with the trapezoidal shaped apertures in the two plates since by the very shape of a trapezoid, there must be substantial space between adjacent trapezoids when lined up in rows as shown in the previous patent, space not available to be used for the resultant hexagonal orifice.

Thus, it is readily apparent that it would advantageous in a sliding plate fluid damper system if resultant hexagonal shaped orifices can be maximized by adopting apertures in the fixed plate and/or sliding plate which permit such an increase in the number of hexagonal shaped apertures in the damper system.

SUMMARY OF THE INVENTION

The present invention provides a sliding plate orifice damper system consisting of a first plate with uniformly spaced apertures slideably secured to a fixed second plate also having uniformly spaced apertures, the system usable in wide variety of fluid flow applications such as channels, outlets, inlets, ducts, pipes, plenums, cells or other fluid handling apparatus. In this discussion, each of the plates have apertures therethrough, and the coincidence of two apertures (one on the top sliding plate and one on the bottom fixed plate) results in an orifice, which may also be called a composite orifice, through which the fluid, gas or liquid, flows.

Briefly, each plate consists of a flat, thin metal or other material sheet which includes a plurality of apertures of unique shape, configuration, and orientation. More particularly, each aperture of each plate is hexagonal in shape with the geometry of the hexagon carefully evaluated to yield the desired linear relationship between relative position of one plate to the other, and rate of fluid flow. The hexagonal shaped apertures on both the fixed plate and the sliding plate are of the same size and arranged in like fashion during fabrication of the plates. The orientation of the fixed plate to the sliding plate is similar to each other in that in the completed damper system, the centerlines of complementary apertures of the two plates slide over each other such that the resultant composite orifice through both plates is hexagonal in shape, and when full opening is accomplished, the apertures completely overlap, one over another.

As the sliding plate moves relative to the fixed plate, the resultant composite orifice changes from an arrangement where the width (in the direction of travel) is considerably shorter than the length (perpendicular to the direction of travel) when the damper is at fully closed, to an arrangement where the width expands considerably with more travel. The damper may then proceed to full open position. The result of this unique geometry of orifices, and relative positioning of orifices, is that the performance of the damper system is such that there is a linear relationship between a change in sliding plate to fixed plate position (as measured by percentage of travel from full close to full open) and the change in air flow through the damper (measured from zero flow to full flow).

With the apertures through each of the plates being hexagonal in shape, apertures may be more closely spaced to each other without touching each other or overlapping on the same plate or overlapping an aperture on the other plate, in which case, unintended orifices would be formed. Thus, with the hexagon aperture configuration in each of the two plates, much more area is devoted to orifice passageway and thus the volume of fluid flow is increased substantially.

The hexagonal shaped apertures of each plate are arranged in rows and columns in both the fixed plate and the sliding plate, with rows alternated with space in between.

In addition, the throttling characteristics of the damper system, i.e., the performance of the invention at near-zero opening, have been greatly enhanced with the new design.

It is an object of the subject invention to provide a sliding plate orifice damper system which provides a linear relationship of the sliding plate (relative to the fixed plate position) to fluid flow through the system.

It is another object of the subject invention to provide a sliding plate damper system having means by which the ability to accurately, reliably, and repeatedly adjust and control the fluid flow may be assured.

Other objects of the invention will, in part, be obvious and will, in part, appear hereinafter. The invention accordingly comprises the apparatus possessing the construction, combination of elements, and arrangement of parts which are exemplified in the following detailed disclosure and the scope of the invention which will be indicated in the Claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION

Figure 1:
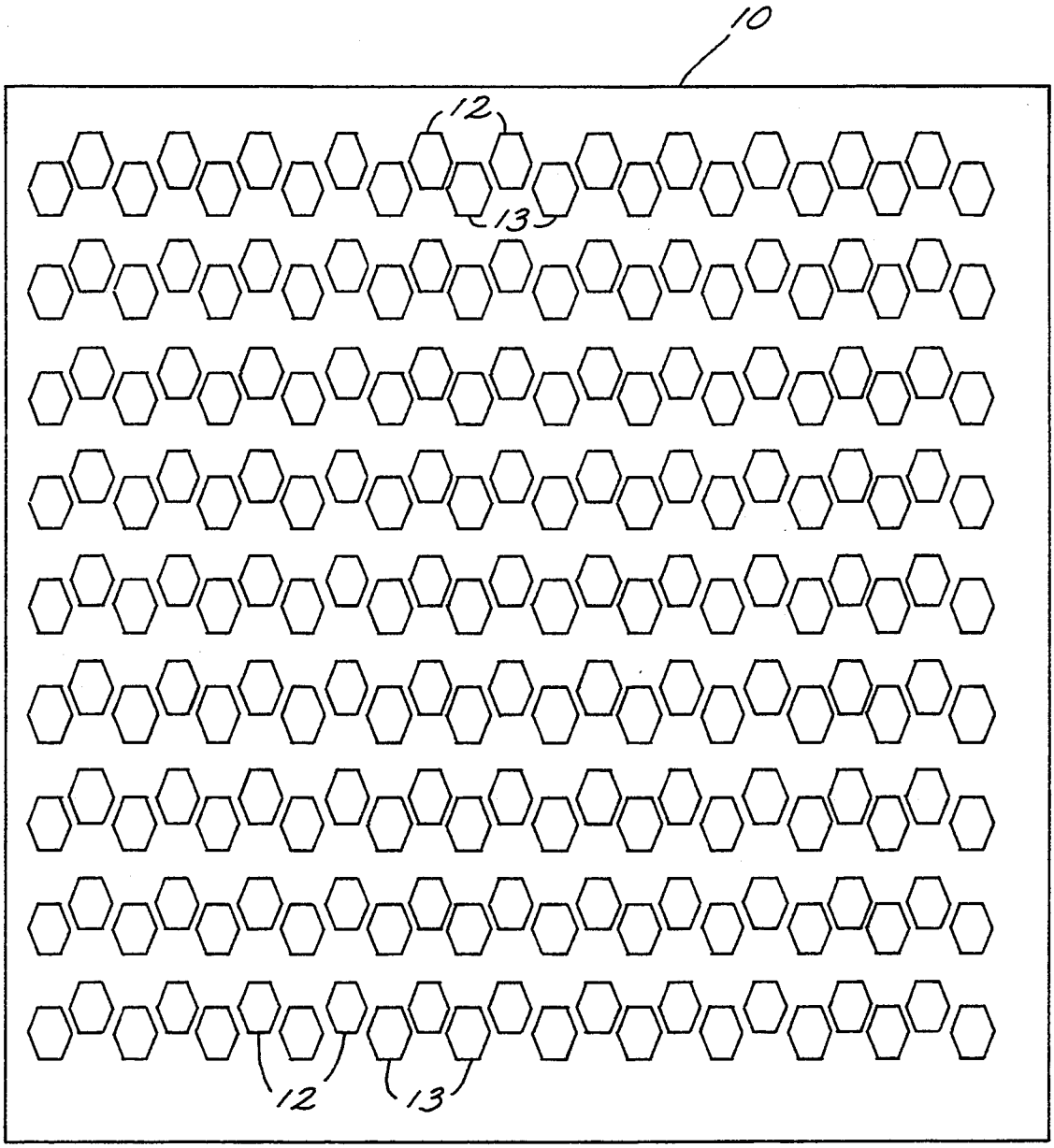
FIG. 1 is a top plan view of the bottom fixed plate of the subject inventive improved linearly adjustable fluid damper.

Referring now to FIG. 1, a top plan view is shown of bottom plate 10 of the subject inventive sliding plate orifice damper system wherein the orientation arrangement of the hexagonal shaped apertures 12 and 13 is illustrated. As previously mentioned, the plate is preferably constructed of thin sheet metal, such as steel or aluminum, or a composite of materials of comparable strength and rigidity, and will usually be rectangular or square in shape, especially when utilized in an under-the-floor cell application in clean rooms.

Arranged in rows and columns are the plurality of hexagonal apertures 12 and 13. The pattern of apertures on the stationary bottom plate is that of a series of two evenly spaced rows commencing with the top row of first series apertures 12 which is then repeated in the exemplar drawing. A second series of evenly spaced rows of apertures 13 are situated slightly below the first series of apertures 12 rows. The rows of the first series apertures 12 and the rows of the second apertures 13 are then interlaced.

Not only are the rows of first and second series apertures interlaced but the apertures 12 of the first series rows and apertures 13 of the second series rows are aligned with respect to each other in separate columns. A column comprises one hexagonal aperture 12 in each of the first series rows and one hexagonal aperture 13 in each of the second series rows. Naturally, the number of rows and columns (of the first and second series), will vary depending upon the dimensions of each hexagonal aperture in relationship to the size of the plate, and of course the size of the plate will also vary.

It is noted that none of the mechanical details used for alignment of plates or for assisting the movement of the sliding plate are shown in FIG. 1. As mentioned earlier, FIG. 1 is set out to show the pattern and orientation of the hexagonal apertures.

Although it may not be clear at this point, the pattern of hexagonal apertures 12 and 13 shown in FIG. 1 is a very efficient arrangement of apertures in that when the top sliding plate 20 (FIG. 2) of the damper system is in position atop bottom plate 10 (FIG. 1), each hexagonal aperture of the top plate so interacts with its counterpart of the bottom plate that no hexagonal aperture will intersect with more than one other hexagonal aperture at any time. In other words, at no time will a hexagonal aperture in the top sliding plate form a resulting orifice through both plates with more than one hexagonal aperture of the bottom plate, and visa versa. The spacing then between rows is necessary to allow appropriate blocking of the apertures (or parts of the aperture) not contributing to the desired composite orifice.

In the preferred embodiment using steel or aluminum plates, the hexagonal aperture shown in bottom plate 10 were formed by the punch process utilizing dies. Of course, other types of material for the plate may require other known manufacturing techniques to form the apertures. It is noted with the construction of plate 10 shown in FIG. 1, much structural integrity has been preserved.

Figure 2:
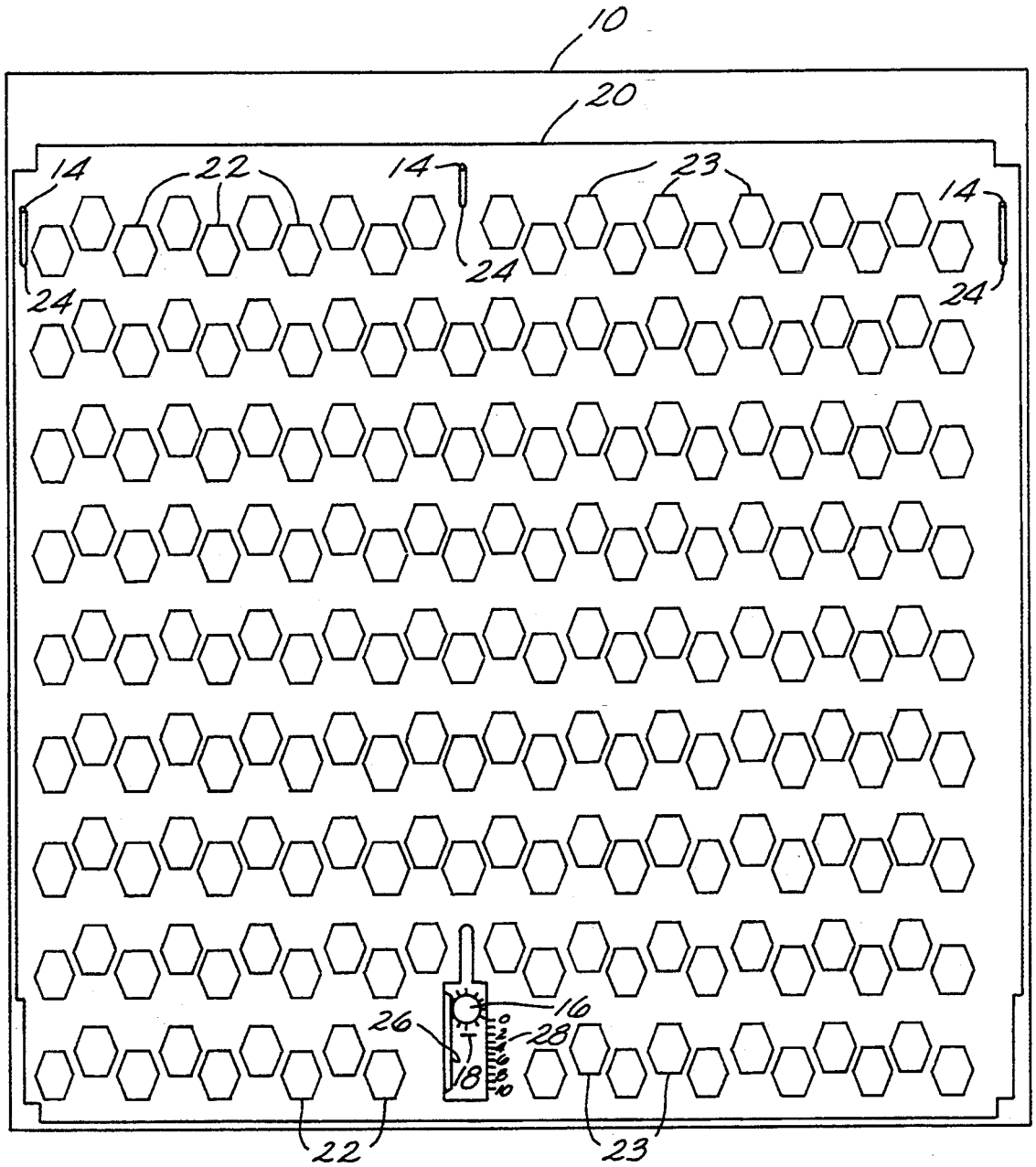
FIG. 2 is a top plan view of the top sliding plate overlying the bottom fixed plate.

FIG. 2 is a top plan view of top sliding plate 20 situated over fixed bottom plate 10 to form the inventive sliding plate orifice damper system. For ease of viewing and to reduce possible confusion, apertures in bottom plate 10 are not shown as sliding plate 20 is shown in fully closed configuration wherein the hexagonal apertures of bottom plate 10 underneath are totally covered by non-aperture area of top plate 20.

Continuing in FIG. 2, apertures 22 and 23 of top plate 20 are arranged in a similar arrangement as exemplified in bottom plate 10 with first series of rows of apertures 23 and second series of rows of apertures 22 with the second series of hexagonal apertures 22 interlaced with those of the first series hexagonal apertures 23. With this configuration, first series row apertures 12 of bottom plate 10 align with and are overlapped by first series row apertures 22 of top plate 20. The same analogy applies with respect to second series row apertures 12 of bottom plate 10 and second series row apertures 22 of top plate 20.

Also shown in FIG. 2 are the mechanical means by which the two plates relate to each other. Firstly, guide slots 24, three of which are shown (two located on opposite sides of sliding plate 20 and a centrally located guide slot), are so arranged as to receive guide post 14 from bottom plate 10. Guide post 14, in riding in guide slots 24, restrain side to side movement of top plate 20 upon fixed bottom plate 10 so that apertures 22 and 23 in top plate 20 as top plate 20 remain in centerline alignment with apertures 12 and 13 of bottom plate 10. Further shown in FIG. 2 is toothed gear 16 rotatably attached to bottom plate 10 adapted to engage slotted rack 26 attached to top plate 20. Through rotation of toothed gear 16, sliding plate 20 is moved in the direction of the elongated guide slots 24 such that more or less composite orifice size is formed by the overlapping apertures.

Lastly shown in FIG. 2 is calibrated scales 28 inscribed upon the edge of the opening through top sliding plate 20 located in the proximity of datum point 18 inscribed on bottom plate 10. By use of calibrated scale 28 in conjunction with datum point 18, the relative position of top sliding plate 20 upon bottom fixed plate 10 may be easily ascertained.

Figure 3:
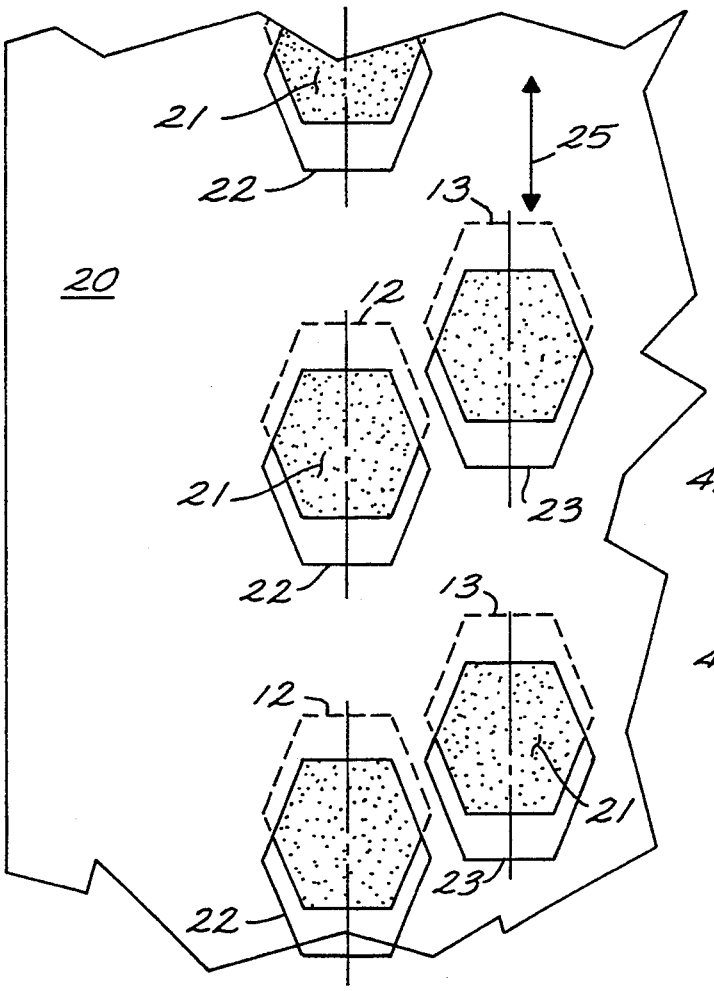
FIG. 3 is a top plan view of a portion of the top plate operating over the fixed plate to form resultant orifices.

Referring now to FIG. 3, a cut-out section of FIG. 2 is shown in an enlarged top plan view. Seen in FIG. 3 are hexagonal apertures 22 and 23 of top sliding plate 20 overlapping hexagonal apertures 12 and 13 respectively of fixed bottom plate 10. The centerline of each hexagonal aperture 22 of top plate 20 is longitudinally aligned with the centerline of each aperture 12 of the bottom plate 10 so that as top plate 20 moves in either direction shown by arrow 25, the composite orifice 21 (shown in dots) formed by both hexagonal apertures 12 and 22 may be varied from the almost fully opened position illustrated to a position of zero or no resultant composite orifice through downward movement of top plate 20. Top plate 20 is so indexed by relative placement of guide slot 24 in the preferred embodiment that the starting point of top plate 20 (zero percent travel and zero composite orifice) is when the upper side of hexagonal aperture 22 coincides with the lower side of hexagonal aperture 12. From that starting position, top plate 20 moves upward in the direction shown by arrow 25 until the top and bottom sides respectively of both hexagonal apertures coincides, at which time there will be full opening and maximum flow of fluid through the orifice.

The resultant area of the composite orifice formed by the overlapping hexagonal apertures varies non-linearly with respect to linearly movement of sliding plate 20. The observed result however is that the fluid flow through the composite orifice is rendered a linear relationship versus sliding plate displacement. The law of fluid flow through an orifice relates the square of the area ratios of two similar orifices, thus, the non-linear relationship of the composite orifice area substantially satisfies the law of fluid dynamics to render a linear relationship between relative positions of the plates and the fluid flow.

The formula governing fluid flow to orifice area relationship is:

$$Q=KA\ 2g_c h_f$$

Where

Q=Discharge rate
K=Constant
A=Area of the Resultant Orifice
$g_c$=Gravitational Constant
$h_L$=Loss of Head Assuming the orifice constant K and the head loss $h_f$ are essentially constant, the discharge rate is dependent on the orifice area, or the aggregate area of the orifices, in this case, of the damper.

Using the resultant orifice area formulas for squares/rectangles: $A=ab$; for octagons: $A=4.83L^2$; for circles: $A=0.7854D^2$; for trapezoids: $A=\frac{1}{2}(a+b)h$; and for hexagons: $A=2.6L^2=(a+b)h$, when substituted into the above formula, it was evident that for staggered hexagonal orifices, hexagons yield an accurate linear relationship between air flow and slide plate orifice movement with the greatest air flow discharge and throttling capability.

Using circles or shapes closely approximating a circular configuration, such as octagons, does not result in a linear relationship between quantity of open area of a composite orifice and the amount of slide plate movement. The rectangular or square orifice configurations, although yielding a linear relationship between slide plate movement and orifice open area, does not have the throttling capability of hexagonal openings due to the height to width ratio of the open area. A trapezoid opening will provide a linear relationship between slide plate movement and the orifice open area and the desired throttling effect, but does not maximize the use of the available surface area. However, the advantage of the hexagonal orifice is that it provides the linear relationship between the slide plate movement and the composite orifice open area with a greater discharge rate because a larger hexagon orifice can be placed in the identical plate surface area which would be occupied by a trapezoidal orifice.

Figure 4:
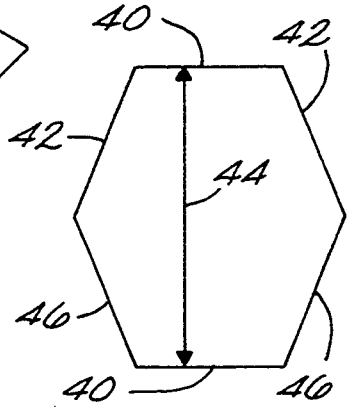
FIG. 4 is a drawing of the preferred hexagonal shaped apertures through the plates.

This relationship of resultant hexagonal shaped damper orifice opening (as a movement of the top sliding plate) from zero to full open versus the percent of fluid flow (measured as a percent from zero fluid flow to one hundred percent) under conditions of constant pressure was illustrated in the graph of FIG. 4 of U.S. Pat. No. 5,218,998.

It has been determined that for best results, the hexagonal aperture in both the fixed and slideable plates has a relationship such that the length of base 40 (and top 40) is approximately one-half height 44. In such cases, the lengths of sides 42 and 46 are equal and about 20% longer than base 40.

Figure 5:
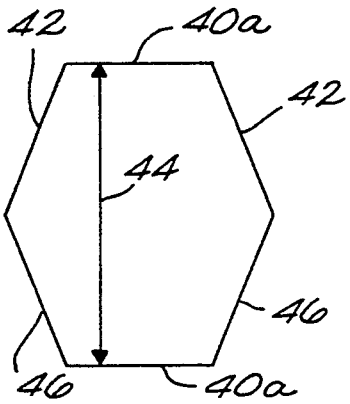
FIG. 5 is a drawing of an alternate embodiment of the hexagonal shaped apertures formed in each of the plates.

It is possible with the invention to provide much improved throttling of fluid flow through the damper for very small fluid flows, for example, when air flow is just initiated. In this embodiment, a hexagonal aperture such as shown in FIG. 5 is utilized. The hexagon shown in FIG. 5 is characterized by two short sides, here namely top and bottom sides 40*a*, where all other dimensions, such as the lengths of sides 42 and 46, as well as height 44, remain the same as in the preferred embodiment. The advantage of short tops and bottoms 40*a* in throttling applications may be discerned from the application of the invention shown in FIG. 3 detailing orifice 21 (shown in dotted form) formed between aperture 22 of top plate 20 and aperture 12 of bottom plate 10. With the shortened top and bottom sides, as the apertures overlap to form the resultant orifice 21, relatively large movements in top sliding plate 20 results in a much lessened rate of increase of orifice area than is the case for a top and bottom having lengths shown as seen in FIG. 4. By this means, effective throttling of the resultant orifice near zero or down to zero is possible and, similar linear results are obtained over the range of the damper being made fully open.

For good results from throttling effects, it has been determined that the length of the tops and bottoms should be in the order of one-fourth height 44 of each of the apertures.

Figure 6:
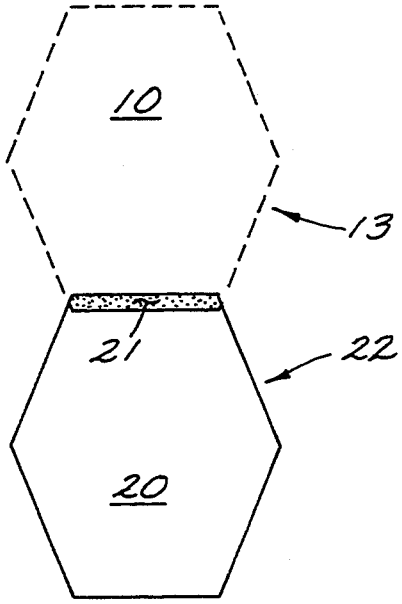
FIG. 6 is a drawing showing the alternate embodiment in a throttling or near-zero opening configuration.

By such means, the resultant composite orifice, shown in FIG. 6, allows for a small orifice to be initially formed as the two apertures, i.e., the apertures in fixed plate 10 and in sliding plate 20, begin to overlap. It is noted that even orifice 21, from its very inception, always forms a hexagon, although initially it is one characterized by long sides on two of the sides and short sides on the other four.

Figure 7:
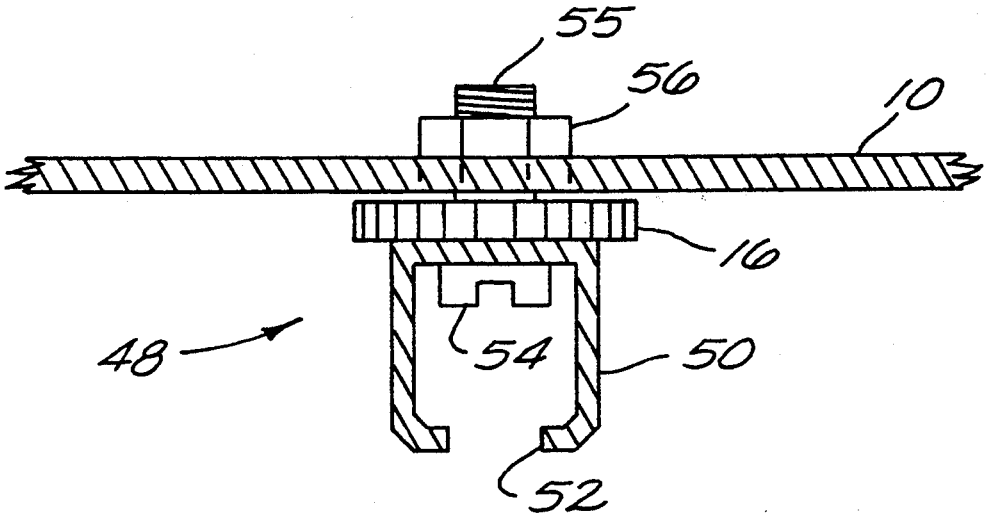
FIG. 7 is a partial sectional view showing the position actuator for adjustment of the sliding plate relative to the fixed plate.
Figure 8:
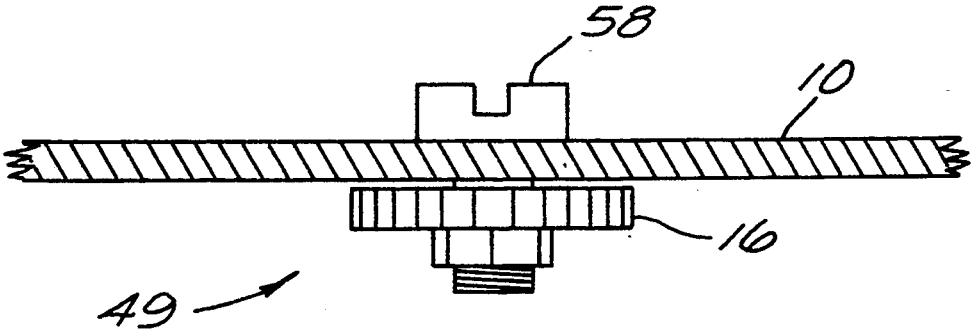
FIG. 8 is an alternate embodiment of the actuator show in FIG. 7.

FIGS. 7 and 8 show details of actuators by which precision adjustment of sliding plate 20 relative to fixed plate 10 may be accomplished. Shown in FIG. 7 is actuator 48 in partial cross-sectional view consisting of toothed gear 16 (also shown in FIG. 2) adapted to engage toothed rack 26 attached to the sliding plate. Secured to toothed gear 16 is bell housing 50, bell housing 50 having hexagon shaped opening 52 to receive a hexagonal wrench. Interiorly to bell housing 50 is machine screw 54, which is shown with a crosswise slot for rotation to tighten and secure actuator 48. The shank of machine screw 54 continues through fixed plate 10 to engage nut 56 secured to fixed plate 10.

To adjust sliding plate 20, a hexagonal wrench (not shown) is inserted in hex opening 52 of bell housing 50. By rotation of the hexagonal wrench, bell housing 50 is rotated to rotate tooth gear 16. This causes sliding plate 20 (not shown) to move relative to fixed plate 10. Adjustment of the resultant orifice through both plates is made this way. Once the desired position of the sliding plate has been accomplished, further rotation of bell housing 50 is terminated. Then, the operator inserts a screwdriver into hex opening 52 to engage the slot in machine screw 54, turning it to tighten bell housing 50 to fixed plate 10, and thus lock the sliding plate in place.

FIG. 8 illustrates simplified actuator 49 in an alternate embodiment wherein tooth gear 16 is rotated by rotation of machine screw 58, tooth gear 16 being attached to the shank of machine screw 58. A slot is shown in the head of machine screw 58 to receive a screwdriver to rotate the tooth gear. Also shown in FIG. 8 is fixed plate 10 through which the shank of machine screw 58 protrudes to engaged tooth gear 16.

While a preferred embodiment of the device has been shown and described, together with an alternate embodiment thereof, it will be understood that there is no intent to limit the invention by such disclosure, but, rather it is intended to cover all modifications and alternate constructions falling within the spirit and the scope of the invention as defined in the appended Claims.

We claim:

1. An improvement in sliding plate orifice dampers utilized in fluid handling systems, the sliding plate orifice dampers of the type having a fixed plate with an aperture therethrough and a sliding plate also having an aperture therethrough, the improvement comprising:

a fixed plate having at least one hexagonal shaped aperture therethrough; and a sliding plate also having at least one hexagonal shaped aperture therethrough, said sliding plate movable linearly relative to said fixed plate, said sliding plate juxtaposed said fixed plate such that said aperture of said sliding plate is in close proximity to and overlaps said aperture of said fixed plate to form a resultant composite hexagonal shaped orifice to pass fluid through both said fixed plate and said sliding plate, said sliding plate linear displacement having a straight line relationship characteristic to volume of fluid flow from zero flow to maximum flow through said orifice, said sliding plate slideably adjustable to select a known volume of fluid flow.

2. The improvement in sliding plate orifice dampers as defined in claim 1 wherein said hexagonal shaped aperture in said fixed plate has an orientation relative to said fixed plate, and said hexagonal shaped aperture in said sliding plate also has an orientation relative to said sliding plate, said sliding plate slideably juxtaposed said fixed plate such that said orientation of said hexagonal shape aperture of said sliding plate will slideability overlap at least a portion of said hexagonal shaped aperture of said fixed plate.

3. The improvement in sliding plate orifice dampers as defined in claim 2 wherein each said hexagonal shaped aperture of said fixed plate and of said sliding plate has a top side and opposite bottom side, and a height between said top and said bottom side, and said hexagonal shaped aperture of said fixed plate and of said sliding plate each define a center line bisecting said top and said bottom side.

4. The improvement in sliding plate orifice dampers as defined in claim 3 wherein said center line of said fixed plate hexagonal shaped aperture coincides with said center line of said sliding plate hexagonal shaped aperture when forming said resultant composite orifice.

5. The improvement in sliding plate orifice dampers as defined in claim 4 further including means to align said sliding plate to said fixed plate, said means to align maintaining said center line of said sliding plate hexagonal shaped aperture coincident with said center line of said fixed plate hexagonal shaped aperture as said sliding plate is moved linearly relative to said fixed plate, and means to controllably adjust said position of said sliding plate relative to said fixed plate.

6. The improvement in sliding plate orifice dampers as defined in claim 5 further including means to throttle the fluid flow through said resultant composite orifice when in a near zero fluid flow configuration.

7. The improvement in sliding plate orifice dampers as defined in claim 6 wherein said means to throttle the fluid flow in near zero fluid flow configuration includes said top side and said bottom side of said hexagonal apertures in both said sliding plate and fixed plate being of a length one-quarter the length of said height between said bottom side and said top side.

8. The improvement in sliding plate orifice dampers as defined in claim 7 wherein said fixed plate is planar and said sliding plate is also planar.

9. An improvement in sliding plate orifice dampers utilized in fluid handling systems, the sliding plate orifice dampers of the type having a fixed plate with a plurality of apertures therethrough and a sliding plate also having a plurality of apertures therethrough, the improvement comprising:

a fixed plate having a plurality of hexagonal shaped apertures therethrough; and a sliding plate also having a plurality of hexagonal shaped apertures therethrough, said sliding plate movable linearly relative to said fixed plate, said sliding plate juxtaposed said fixed plate such that one each of said plurality of apertures of said sliding plate is in close proximity to and overlaps one each of said plurality of apertures of said fixed plate to form a plurality of spaced apart resultant composite hexagonal shaped orifices to pass fluid through both said fixed plate and said sliding plate, said sliding plate linear displacement having a straight line relationship characteristic to the volume of fluid flow through said plurality of orifices, said sliding plate slideably adjustable to select a known volume of fluid flow.

10. The improvement in sliding plate orifice dampers as defined in claim 9 wherein said plurality of hexagonal shaped apertures have an arrangement on said fixed plate and said plurality of hexagonal shaped apertures have an arrangement on said sliding plate, said arrangement of hexagonal shaped apertures on said sliding plate complimentary to said arrangement of hexagonal shaped apertures on said fixed plate such that said plurality of apertures of each said sliding plate and fixed plate overlap to form a plurality of resultant composite hexagonal shaped orifices and apertures of said fixed plate overlap no more than one aperture of said plurality of apertures of said sliding plate respectively.

11. The improvement in sliding plate orifice dampers as defined in claim 10 wherein each of said plurality of hexagonal shaped apertures of said fixed plate and said sliding plate have a top side and opposite bottom side, and a height between said top and bottom side, and said hexagonal shaped apertures of said fixed plate and of said sliding plate each define a center line bisecting said top and said bottom side.

12. The improvement in sliding plate orifice dampers as defined in claim 11 wherein said center line of each of said fixed plate hexagonal shaped apertures coincide with said center line of each of said sliding plate hexagonal shaped apertures respectively when forming said resultant composite orifices.

13. The improvement in sliding plate orifice dampers as defined in claim 12 further including means to align said sliding plate to said fixed plate, said means to align maintaining said center line of said sliding plate hexagonal shaped apertures coincident with said respective center line of said complimentary fixed plate hexagonal shaped apertures as said sliding plate is moved linearly relative to said fixed plate, and means to controllably adjust said position of said sliding plate relative to said fixed plate.

14. The improvement in sliding plate orifice dampers as defined in claim 13 further including means to throttle the fluid flow through said plurality of resultant composite orifices when in a near zero fluid flow configuration.

15. The improvement in sliding plate orifice dampers as defined in claim 14 wherein said means to throttle the fluid flow in near zero fluid flow configuration includes said top side and said bottom side of said plurality of hexagonal apertures in both said sliding plate and fixed plate being of a length one-quarter the length of said height between said bottom side and said top side.

16. The improvement in sliding plate orifice dampers as defined in claim 15 wherein said fixed plate is planar and said sliding plate is also planar.

* * * * *